United States Patent [19]

Takeda et al.

[11] 4,321,091

[45] Mar. 23, 1982

[54] METHOD FOR PRODUCING HOT FORGED MATERIAL FROM POWDER

[75] Inventors: Yoshinobu Takeda; Nobuhito Kuroishi; Susumu Noji, all of Hyogo, Japan

[73] Assignee: Sumitomo Electric Industries, Ltd., Osaka, Japan

[21] Appl. No.: 76,947

[22] Filed: Sep. 19, 1979

[30] Foreign Application Priority Data

Sep. 27, 1978 [JP] Japan ..... 53-117897
Sep. 27, 1978 [JP] Japan ..... 53-117898

[51] Int. Cl.[3] ..... B22F 3/00

[52] U.S. Cl. ..... 75/213; 29/420.5; 73/226; 73/214; 73/211; 148/126

[58] Field of Search ..... 148/126; 75/213, 226, 75/214, 211; 29/420.5

[56] References Cited

U.S. PATENT DOCUMENTS

| | | | |
|---|---|---|---|
| 2,301,805 | 11/1942 | Harder | 75/213 X |
| 2,637,671 | 5/1953 | Pavitt | 148/126 |
| 3,381,022 | 12/1968 | Walff | 75/213 X |
| 3,889,350 | 6/1975 | Mocarski | 25/226 X |

FOREIGN PATENT DOCUMENTS

| | | | |
|---|---|---|---|
| WO79/00833 | 10/1979 | PCT Int'l Appl. | 148/126 |
| 1226909 | 3/1971 | United Kingdom | 148/126 |

OTHER PUBLICATIONS

Hirschhorn, J.S., *The Forging of Powder Metallurgy Preforms,* Metal Forming, 37(11):320–327, Nov. 1970.

*Primary Examiner*—Brooks H. Hunt
*Attorney, Agent, or Firm*—Wenderoth, Lind & Ponack

[57] ABSTRACT

A method for producing a powder forged material comprising 1.4~3.5% Si, 0.2~0.9% Mn and 1.0~2.0% C by weight, the remainder substantially consisting of iron is provided herein. This method consists in (a) pulverizing the swarf of an FCD cast iron mother material and separating and removing graphite microparticles from the mother material to produce a powder body of said mother material having a carbon content of 1.0~2.5%; (b) preforming the powder body having the reduced carbon content to a density lower than that of the mother material and applying a lubricant to the preformed body; (c) heating the preformed body at a temperature above the melting point of the mother material but below 1300° C. in a non-carburizing atmosphere and then cooling the preformed body until the temperature of the body is lowered to 1000°~1100° C. and forging the preformed body in a dye so that the specific gravity is the same or slightly higher than that of the mother material and, finally, (d) subjecting the forged body to a diffusion treatment by heating it above the austenitizing temperature. The present invention also relates to forged materials produced by this method.

3 Claims, 4 Drawing Figures

X 100

X 400

METHOD FOR PRODUCING HOT FORGED MATERIAL FROM POWDER

The invention relates to a method for producing a hot forged material from powder having high mechanical properties, such as wear resisting slidability, tensile strength, compression strength and the like, for use in assemblies, for example, steel gears, cams, etc.

The powder forged parts are now steadily replacing ordinary forged parts and machined parts because of their superior economy of powder metallurgy, high rate of yield of material, their capability of drastically abbreviating the machining process, such as cutting and the like, and for their uniformity of quality. However, the powder forged parts have a disadvantage in that they are not always competitive with the wrought material in respect of the market price due to the unbalance of the performance such materials and the production cost (the cost of material and the processing cost) in the stage of industrialization. The main sphere where the powder forged parts are expected to be used is represented by assemblies, such as steel gears, cams and the like, and the properties required of such assemblies are, needless to mention, high tensile strength, as well as high compression strength and toughness. What is more important is the high degree of hardness required for wear resistance as well as suitable slidability. Particularly, the latter property is not obtainable from the simple hardness or toughness of the material, since it is obtainable only when the metallic microstructure is in the most suitable condition. Moreover, inasmuch as all these requisites should be satisfied synchronously, there were great technical or economical difficulties in the case of the conventional materials. For example, a cast iron material had less strength and toughness because of the contained brittle graphite particles and interface void of the particles, despite the fact that it had high wear resisting slidability due to the action of the contained graphite articles (flaky or spherical). The cast metal was therefore not a suitable material because of the heterogeneity of its cast structure and the unavoidability of segregation. In the case of carbon steel and lowgrade low alloy steel materials, a specific surface treatment, for example, nitriding, was necessitated because of the inferior wear resistance and slide resistance of these materials, even when the strength and toughness could be reinforced by a suitable heat treatment. Furthermore, the wrought steel material is disadvantageous in that the existence of nonmetallic component, unremoved in the steelmaking stage was negligible, and moreover the orientation of the material produced by the forging and rolling process was apt to impair the uniformity of the strength of the assembly. The conventional powder forged parts also were not free from the aforesaid difficulties. Therefore, materials having high strength and wear resisting slidability have not yet been obtainable.

The power forging technology has long been known as an effective method for improving the strength and toughness by crushing the pores of the sintered body. A great deal of research and development has been carried on to perfect the methods of producing materials, particularly ferous materials by means of powder forging. Conventionally, this method has had the greatest disadvantage in that the product is competitive in respect to the cost of the product. In order to obtain as high a strength as that of wrought steel materials, the use of high-priced powder materials and expensive production methods were necessitated. Accordingly, low-priced powder materials and inexpensive processes have been locked forward to so that economy of the product can be improved, thereby enabling one to put the powder forging method to practical use.

On the other hand, with the recent advent of conserving natural resources and energy, serious consideration is being paid to the use of swarf in powder metallurgical processes, which swarf is produced in a large amount as industrial waste. The swarf comprises a large variety of materials, such as non-ferrous metals, steel, cast iron, etc., among which cast iron swarf has attracted attention for its easy treatment. The said swarf material has been hot forged by solidifying it as it stands or by pressing it after pulverizing it by various methods. Though the cost of material is relatively low, there is no great price difference between ordinary cast iron and forged product obtained by the said material. Thus, the powder forged product has failed in meeting the requirements of the market. While low-priced raw material and inexpensive processes are looked forward to, no method has yet been introduced that can meet the general economical requirements. Thus, powder forged products have not yet come into general use.

According to the invention, assembly materials of unprecedentedly high performance can be produced by the combined use of a production technique and of a compound alloy, which is characteristic of powder metallurgy and which is difficult to obtain by the conventional wrought method and a production techniques. According to the present invention, density and freedom from pores and the like can be obtained, like that materials of high of the powder forging technique.

The invention will now be described in detail in reference to the accompanying drawings.

FIG. 1 is a chart for explaining the heating temperature of a preformed body according to the invention and the degree of progress of sintering.

FIG. 2 is a chart showing the result of a wear test of a forged body obtained according to Example 2 of the invention. The test was conducted against the material, S-55C(HV-270) under the conditions of: a pressure of 10 kgf/cm$^2$; a distance of 500 m; and without a lubricant. The solid line represents S-55C, the dotted line representing gray cast iron (FC-25), the broken line representing the product according to the invention, respectively.

After a careful research of obtaining a powder forged product which is low-priced and has high strength properties, the inventors of the present invention have reached the conclusion that the inferior strength of a hot forged body produced from pulverized powder of cast iron swarf is attributable to the flaky graphite pieces contained in the structure and the pores therearound. This, in order to obtain materials of a sufficiently high strength, by reinforcement of the alloy elements of the base phase are necessary impediments. The graphite particles in the base structure can be removed by various methods, for example, a chemical method, a thermal method, a mechanical method, etc.

However, in order to preclude economic losses arising from extra processes, the selection of proper pulverizing conditions in the pulverizing process and the selection of the proper size classification of the pulverized powder are necessary to for increasing the removal rate of the graphite, whereby it has been made possible to obtain a powder containing only 1~2% carbon as the total amount. To be more precise, it has been made possible to pulverize spherical graphite particles with up to about 3% of graphite in the mother material and remove the graphite from the base phase in the form of microparticles, said microparticles being removed by continuously classifying them according to the difference in the specific gravity and dimensions thereof. The low graphite powder thus-obtained was preformed to a density of 80~85% of the specific gravity of the mother cast iron. The said range of the specific gravity was selected so that the rate of the pores of the preformed body will be within the most suitable range in respect to dewaxing and strength. Furthermore, the preformed body was coated with a lubricant for use in hot forging.

As the preliminary heating conditions for forging, the following are the prerequisites: (a) to dissolve the free graphite in austenite; and (b) to sinter the powder particles so as to heighten the deformability.

Figure 1:
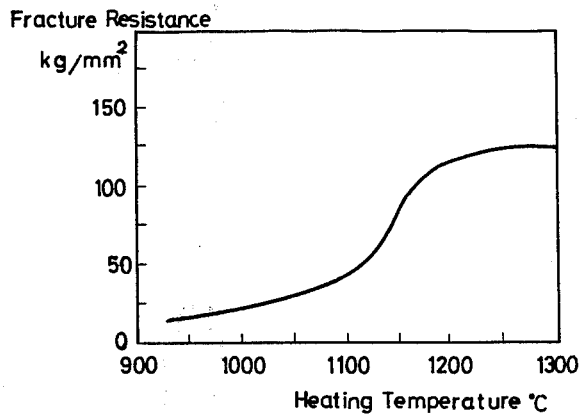

From the interrelation between the heating temperature and the strength chosen as a measurement of the degree of progress of the sintering as shown in FIG. 1, it has been found that according to the invention heating to temperatures above the melting point of the mother cast iron are the conditions enabling one to obtain the best result. Even when heated above the melting point of the mother cast iron, the preformed body does not melt for the reasons that: (1) the melting point of the powder has been heightened as a result of reducing the amount of graphite powder, and (2) the graphite has been dissolved into the austenite phase in the course of heating, there remaining only a small amount of graphite particles when the temperature reaches the eutectic point of the graphite and iron alloy. It is a completely novel finding that the preformed body is free from distortion and even capable of displaying very high properties, when heated above the melting point of the mother material.

In case of the induction heating method, about 10 seconds will be sufficient to satisfy at least the conditions of dissolving the graphite, whereas in the case where an ordinary heating furnace is used, it is necessary to heat the preformed body uniformly to its interior for a certain length of time, for example, about 15 minutes to properly sinter the material. However, simple prolongation of the heating time is not preferable in view of the restrictions of the forging conditions which will be described hereinbelow. Furthermore, a non-decarburizing atmosphere is indispensable under this condition alone, a forged body of uniform structure can be obtained.

The restrictions of the forging conditions are as follows:

(a) the temperature should not exceed the critical temperature above which the die loses its strength;
(b) wear and sticking of the die should not be too great;
(c) friction should not be increased due to deterioration of the lubricant and;
(d) the interior of the preformed body should be homogeneous.

Thus, the aforementioned heating conditions are unsuitable for direct forging, and the temperature should be controlled intermediately. According to the invention, in order to satisfy both the said conditions, a control zone enabling one to obtain a temperature range of 1000°~1150° C. was provided, thereby enabling the surface temperature of the preformed body to be controlled within the said range, and the forging treatment to be effected satisfactorily without impairing the strength and life of the die. It was also found that the said forging treatment made it possible to obtain a forged product of which the specific gravity was 100%~110% of that of the mother cast iron. To be more precise, a highly compact material is obtainable as a result of drastically removing of graphite particles contained in the mother cast iron; decreasing the voids existing between the graphite particles and the base phase, and also by crushing of the voids by means of forging. The maximum specific gravity of 110% can be measured by raising the forging pressure and lowering the amount of carbon content. Practically, however, it is preferable to obtain a forged body having a specific gravity of about 105%. A specific gravity below 100% is not preferable, since the pores and voids become conspicuous with the resultant deterioration of the strength and toughness.

Though the forged body thus-obtained is apparently highly compact, atomic bonding is not necessarily satisfactory on the pressure contact interface between particles. Moreover, since the forged body is not free from distortion attendant on plastic deformation, its mechanical strength properties are not sufficient, if it is used in the state, as it stands. Thus, it is necessary that the forged body be annealed by heating, thereby enabling diffusion to be fully effected on the mechanically contacted interface and distortion to be released. Annealing will have no effect unless it is conducted within the austenite range. It is more preferable that annealing be effected around the temperature showing the maximum carbon content of the iron-carbon material so as to obtain good results.

The most important structural element of the powder forged material obtainable according to the invention consists in graphite microparticles uniformly distributed and removed from the base phase. Needless to say, a material wherein graphite is dispersively educed therefrom has been conventionally known as cast iron. Spherical graphite cast iron in particular was an excellent material with spherical graphite particles dispersed therein. However, the said material had less strength and toughness since the graphite particle was relatively large, for example, 10~100 μm. It was difficult to micronize the graphite particles by the casting method, and it was difficult to drastically change the carbon content, due to resultant precipitation of the hard cementite phase. It has been found, however, that graphite microparticles can be dispersively precipitated uniformly with utmost ease by selecting a powder material in a suitable composition. In the chemical composition thus-selected, the most important is the presence of Si which is a graphitized element of carbon and a reinforcing element of an iron alloy. The range of selection is 1.4~3.5%; the said graphitizing effect being lost if it is below the lowest limit, while the undue hardening of Si dissolution results in brittleness, if it is above the highest limit. As another essential element, Mn should be contained in amounts of 0.2~0.9%. It has the highest effect of improving the hardenability, besides being a reinforcing element of an iron alloy and an element effective for the stabilized presence of graphite. The values of the highest and lowest limits have been determined similarly, according to the effective and harmful ranges thereof. Needless to say, C is the element in graphite, and it is an indispensable element for steel. As described hereinabove, if coarse particles of graphite are present in a great number, they have a bad influence on the strength and toughness of the steel, whereas the wear resisting slidability is reduced if the said number is too small. Furthermore, solidly dissoluble carbon, which is indispensable for reinforcement of the base phase of eutectic steel, should be contained in amounts of about 0.6~0.8%. It has been found that the most suitable amount of carbon necessary for the graphite particles is 1~2%, and more preferably, 1.4~1.8% of the whole carbon content. Other elements, for example, P, S, O, etc., are generally present as unavoidable elements. Since they have no active effect, if below 0.3%, no restrictions are provided insofar as they are mixed as impurities. The same is applicable to the transition elements mixed in the raw material, such as, Mg, Al, Sn, Mo, Cr, Cu and the like.

If the material according to the invention is subjected to a further heat treatment, the matrix is hardened, whereby the strength can be increased and the wear resistance can be improved without impairing the slide resistance.

In this case, the hardness of the matrix is most preferably controlled to 400~600 mHv, the highest and lowest limits being determined in order to obtain the highest effect while avoiding deterioration of the strength, due to overhardening.

The selected composition of material, according to the invention comprises 2~3% Si and 0.2~0.9% Mn, which are substantially the components of FCD cast iron swarf, and the ranges as defined in the claims have been determined in view of the aforesaid effect of reduction of the graphite content.

The invention will now be described in more detail in reference to the following examples.

EXAMPLE 1

The swarf of an FCD spherical graphite cast iron material (Fe 2.6%; Si 0.8%; Mn 3.2% C) was pulverized by means of a high-speed hammer mill, and the contained graphite microparticles were separated by means of a cyclone, to obtain a powder of −60 mesh. The carbon amount of the powder thus obtained was 1.7% whole carbon and 1.6% free carbon. The said powder was preformed into a rectangular shape 10×10×55 mm in dimensions to obtain specific gravity of 5.7 g/cc (80% of the mother material specific gravity). After coating the preformed body with a lubricant for use in hot forging, it was heated at 1200° C. for 10 minutes in a nitrogen gas enriched by a hydrocarbon gas. Immediately thereafter, it was placed in a furnace controlled to 1050° C., and after 5 minutes it was forged in a die to obtain a density of 7.55 g/cc. After being diffusion annealed at 1130° C. for 20 minutes, the forged body was hardened and tempered to measure its strength property. A comparison with the conventional methods is shown in Table 1, in which the contents of the conventional methods, A to D, are as follows.

A: a method known as a sintered forging method in which sintering as a pretreatment is added to the process according to the invention.

B: a method in which the diffusion annealing is omitted from the process according to the invention.

C: a method in which the diffusion annealing is omitted from the process according to the invention and a sintering process is added thereto.

D: a powder forged body produced from marketed pulverized powder of FCD cast iron swarf.

The strengths were compared by leveling the hardness after the heat treatment at HRC40. The conventionally necessitated presintering process is completely unnecessary as apparent from the comparison between (A) and the forged body according to the invention. However, the properties are deteriorated if the after-treatment, diffusive annealing, is omitted. Furthermore, even when the presintering process is added, high properties are unobtainable if the after-treatment, diffusive annealing, is omitted. In case the raw material does not conform with the composition according to the invention, the mechanical property of the forged body is very low, whichever method may be followed, and such product can never meet the demands of the market as powder forged parts.

TABLE 1

| | Fracture Resistance kg/mm$^2$ | Impact Value kg · m/cm$^2$ | Hardness HRC |
|---|---|---|---|
| Method of Invention | 195 | 2.0 | 40 |
| Conventional Method (A) | 193 | 2.1 | 40 |
| Conventional Method (B) | 130 | 1.2 | 40 |
| Conventional Method (C) | 140 | 1.3 | 40 |
| Conventional Method (D) | 110 | 0.8 | 40 |

EXAMPLE 2

Figure 2:
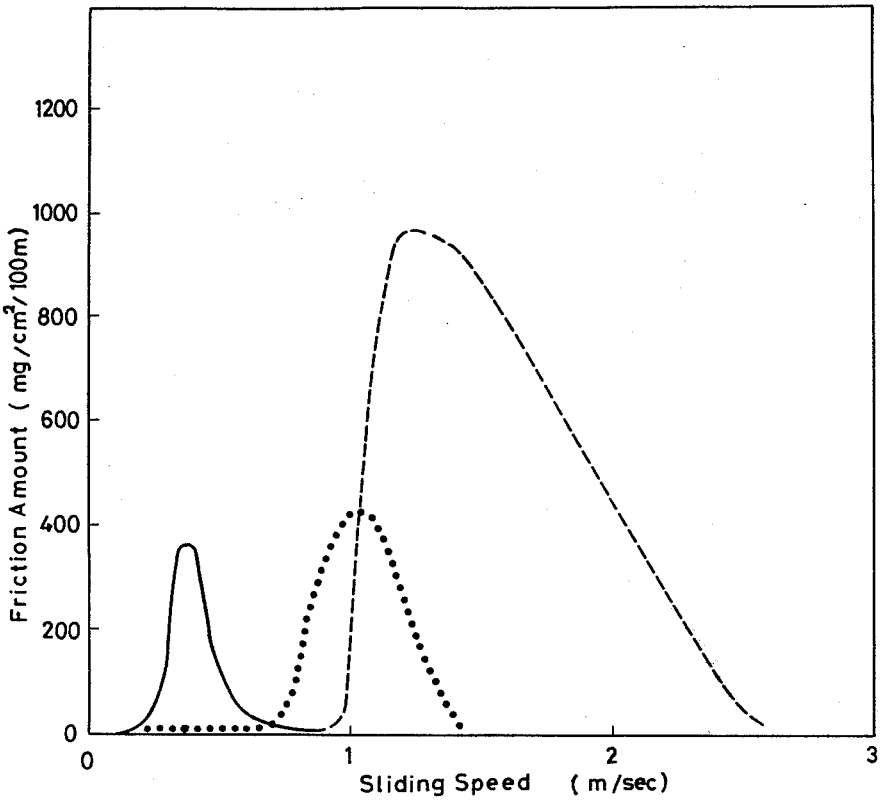
Figure 3:
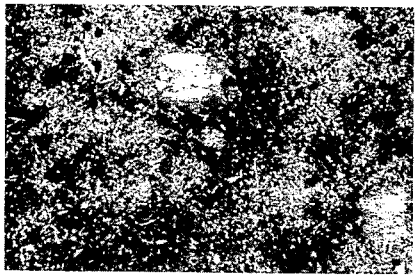
FIG. 3 is a microscopic photograph of 100 magnifications showing the sectional structure of a forged body obtained according to the invention.
Figure 4:
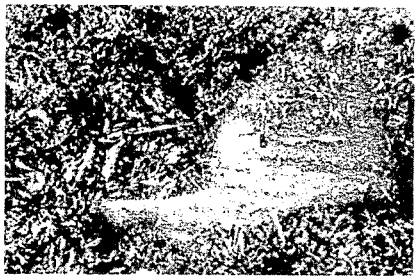
FIG. 4 is a microscopic photograph of 400 magnifications showing the sectional structure of a forged body obtained according to the invention after the heat treatment of hardening and tempering.

A powder of Fe 2.6%, Si 0.8%, Mn 1.7% C was hot forged to obtain a forged body having a specific gravity of 7.6 g/cc. The forged body thus obtained was hardened and tempered at 900° C. The sectional constructions of the respective materials are shown in the microscopic photographs of FIGS. 3 and 4, which clearly show uniform dispersive precipitation of graphite microparticles. Table 2 shows comparisons of the mechanical properties of this example and those of other products, while FIG. 2 shows the results of a wear test. It is now apparent that the material according to the invention has higher properties suitable for mechanical assemblies compared with the conventional products, and is a useful material for extensive use as a powder forged body.

TABLE 2

| | Ultimate Tensile Strength Kg/mm$^2$ | Impact Value Kg · m/cm$^2$ |
|---|---|---|
| Cast Iron | 40 | 1.4 |
| Hardened Body of Invention | 100 | 2.1 |
| Fe—2Ni—0.5M—0.4C Forged Body | 120 | 2.8 |

As described hereinbefore, the present invention provides a concrete and detailed method for producing a powder forged assembly of high performance at low cost, and it is an original and useful method unparalled by any of the known powder forging arts.

What is claimed is:

1. A method for producing a powder forged material comprising 1.4~3.5% Si, 0.2~0.9% Mn and 1.0~2.0% C by weight, the remainder substantially consisting of iron, said method consisting essentially of:

(a) pulverizing the swarf of an FCD cast iron mother material and separating and removing graphite microparticles from the mother material to produce a powder body of said mother material having a carbon content of 1.0~2.5%;

(b) preforming said powder body having the reduced carbon content to a density of 80~85% of the specific gravity of the mother material and applying a lubricant to the preformed body;

(c) heating the thus-treated preformed body at a temperature above the melting point of the mother material and below 1300° C. for 10~900 seconds in a non-carburizing atmosphere and thereafter cooling the preformed body until the temperature of the surface is lowered to 1000°~1100° C. and thereafter forging the preformed body in a die under such pressure conditions that the specific gravity is 100~110% of that of said mother material; and (d) subjecting the forged body to a diffusion treatment by heating it above the austenitizing temperature.

2. A method according to claim 1, in which said forged body is further hardened and tempered until the matrix has a temperature of 400~600 mHv, after the forged body has been subjected to said diffusion treatment.

3. A method according to claim 1 or 2, in which 0.2~1.2% of free carbon from said carbon content is dispersively precipated uniformly as spherical graphite microparticles of 0.5~10 μm throughout the powder forged material.

* * * * *